United States Patent [19]

Uhl et al.

[11] 3,957,670

[45] May 18, 1976

[54] ACTIVATORS FOR INORGANIC PER-COMPOUNDS

[75] Inventors: Klaus Uhl, Neuenhain, Taunus; Hermann Schmadel, Hofheim, Taunus; Gerhart Schneider, Konigstein, Taunus; Eckhard Milewski, Frankfurt am Main, all of Germany

[73] Assignee: Hoechst Aktiengesellschaft, Frankfurt am Main, Germany

[22] Filed: Dec. 4, 1974

[21] Appl. No.: 529,511

[30] Foreign Application Priority Data

Dec. 4, 1973 Germany ..... 2360340

[52] U.S. Cl. ..... 252/102; 252/99; 252/186; 8/111

[51] Int. Cl.[2] ..... C11D 7/54

[58] Field of Search ..... 252/102, 186, 99; 8/111

[56] References Cited

UNITED STATES PATENTS

| | | | |
|---|---|---|---|
| 3,425,786 | 2/1969 | Dithmar et al. | 252/102 X |
| 3,816,319 | 6/1974 | Sarot et al. | 252/99 X |

*Primary Examiner*—Mayer Weinblatt
*Attorney, Agent, or Firm*—Connolly and Hutz

[57] ABSTRACT

Inorganic per-compounds-containing oxidizing, bleaching and washing compositions having a content of acylated oxamides as activators for the inorganic per-compounds. Said activators permit better utilization of the active oxygen while securing good stability to storage.

4 Claims, No Drawings

ACTIVATORS FOR INORGANIC PER-COMPOUNDS

Hydrogen peroxide and other inorganic per-compounds, in particular perborates and percarbonates, are known as active substances in many oxidizing and bleaching compositions or aqueous solutions of bleaching compositions which are used for the most various purposes, especially for bleaching, in some cases also for the simultaneous washing of textile materials. In the acqueous bleaching or washing solutions, the active oxygen of these inorganic percompounds becomes fully active only in the temperature range of about 80° to 100° C. Thus, the use of inorganic per-compounds in bleaching or washing baths is limited to temperature-insensitive textile materials or, in the washing or bleaching of temperature-sensitive synthetic fibrous materials, it must be put up with the fact that the active oxygen present in the bleaching and washing agents remains unutilized in the bath to a large extent.

It has already been proposed in literature to increase the action of a washing or bleaching composition with a compound yielding active oxygen already at low temperatures of below about 70° C by the addition of certain organic compounds, so-called activators. As such activators of inorganic per-compounds, nitrogencontaining compounds have been proposed which contain at least two acyl groups bound to nitrogen (cf. German Pat. Nos. 1,291,317, 1,162,967, German Patent Application No. 1,695,219 laid open to public inspection and Netherland Patent Application No. 6,504,416 laid open to public inspection). Such organic activators are, for example, diacetyl-p-toluidine, tetraacetylethylenediamine, tetraacetylglycoluril and diacetylurea. However, these known products do no satisfy all the requirements demanded in practice from activators for inorganic per-compounds. Besides the activating action on the per-compounds, especially the stability during storage also under unfavourable conditions, for example in a sub-tropic climat, of the bleaching and washing mixtures containing inorganic per-compounds and activators is of great importance for the use of such activators. Thus, for example, for commercial washing agents, for guaranteeing the activity for the period of time from production until use, a storage stability of about half a year is required. This requirement which is essential for the use in practice is not generally fulfilled by the known activators or not to a sufficient degree.

Now, we have found that N,N'-acylated oxamides can be used with particular advantage as activators for inorganic per-compounds.

Thus, the present invention relates to solid, generally powdery to granular oxidizing and bleaching compositions which contain inorganic per-compounds and, as activators, acylated oxamides of the general formula I $$R_1-NH-\underset{\underset{O}{\|}}{C}-\underset{\underset{O}{\|}}{C}-NH-R_2 \qquad (I)$$

in which the radicals $R_1$ and $R_2$ each represent acyl radicals each of 2 to 9 carbon atoms. The acyl radicals contained in a molecule may be identical or different. Such acyl radicals are, for example: acetyl, propionyl, butyryl, chloroacetyl, benzoyl or toluyl. These acyl radicals may also be substituted, for example by nitro groups or halogen. Preferably such compounds of the formula I are used as activators which contain, as acyl radicals, acetyl, propionyl or butyryl radicals, in particular acetyl radicals. It is preferred to use oxamides bearing identical acyl groups.

The compounds of the formula I may be prepared according to known methods, for example by reacting amides of the formula $R_1CONH_2$ with oxalyl chloride or, for example, by reacting oxamide with acids of the general formula $R_1COOH$, in particular, however, with a functional derivative thereof such as the acid anhydride or an acide halide. It is suitable to operate in the presence of a catalyst, for example alkali metal acetate, Lewis acids or strong mineral acids, for example indicated in literature (cf., for example, Houben Weyl, Methoden der organischen Chemie XI/2 (1958) pages 32/33).

The acylated oxamides used according to the invention as activators for inorganic per-compounds are distinguished by a very good activating action. The oxidation, bleaching and washing agents prepared with the acylated oxamides as activators in addition have a surprisingly good, superior stability to storage. Thus, even with prolonged storage time, these oxidation, bleaching and washing agents show only a minute loss of active oxygen with likewise only insignificantly changed oxygen activation; they distinguish in this respect advantageously over the oxidation, bleaching and washing agents prepared using the known activators.

Thus, for example, the brightening obtained with a washing composition containing 18% by weight of sodium perborate and 10% by weight of diacetyl-oxamide (with otherwise usual composition) on a cotton fabric spoiled with tea was after a 4 weeks storage of the washing agent only insignificantly, about 3%, lower than the brightening obtained with a freshly prepared washing agent of the same composition. In contradistinction thereto, the loss of brightening caused by storage for 4 weeks of a washing agent containing 10% by weight of tetraacetyl-glycolurile instead of diacetyloxamide, but otherwise of equal composition, was distinctly higher with about 15%.

In the assessment of the quantity of activator of the invention to be added to the oxidizing, bleaching and washing agents it must generally be taken into account that each acyl group contained in the activator of the formula I may activate one active oxygen atom of the inorganic percompound used. Accordingly, the activator and the inorganic per-compound are theoretically to be used in equivalent amounts in order to fully activate the active oxygen of the inorganic per-compound. In practice, however, often an essentially smaller amount of activator is sufficient. On the other hand, it is also possible to use the activator in a relatively high excess with regard to the inorganic per-compound. In general, the quantity of activator to be used corresponds to a ratio of about 0.5 to 8, preferably 1 to 4 acyl radicals per active oxygen atom of the inorganic per-compound. In practice, the ratio by weight used of activator to inorganic per-compound will in most cases be about 1 : 1 to 1 : 2.

A special advantage of the use of the activators of the invention in oxidation, bleaching and washing agents containing inorganic per-compounds is that the activation of the per-compounds and an acceleration of the oxidation and bleaching process occur already at low temperatures from about 20° C, in particular from temperatures from 30° to 60° C. This acceleration of the oxidation and bleaching process can be observed also at elevated temperatures of up to 75° C and even up to 95° C. This activation and acceleration of the oxidation and bleaching process permits to shorten the treatment temperature or/and the period of action with equal action.

The conditions applied in practice in the respective oxidation or bleaching processes such as temperature and treatment time, concentration of the inorganic per-compound and of the activator as well as the pH-value of the treating bath depend in the first instance on the substrat to be oxidized or bleached or on the accompanying substance present during the bleaching process. The concentration of the inorganic per-compounds in the mostly aqueous oxidizing, bleaching and washing baths is above all dependent on the effect of oxidation or bleaching desired. In general, the concentration of the per-compounds is so adjusted that the baths contain about 10 to 500, preferably 50 to 300 mg of active oxygen/liter. The pH-value of the oxidizing and bleaching baths can vary within the wide limit of about pH 7 to pH 12.

The combination of inorganic per-compounds and activators of the invention may be used for the most various purposes as oxidizing and bleaching agents where hitherto peroxide-compounds, in particular hydrogen peroxide or perborates, per-phosphates, per-silicates, per-sulfates and alkali metal per oxides have been used. Thus, it may be used in the bleaching of waxes, fats, oils and hydrocarbons, in the oxidation and passivation of light metal surfaces, in the desinfection and sterilization, in the bleaching of animal skins, furs and hair as well as of humain hair, and especially in the bleaching washing of fibers of native or synthetic origin and of textiles made thereof.

Preferably, the activators of the invention are used together with inorganic per-compounds in bleaching and washing agents for textiles. As textiles, there are to be understood those which may be washed and bleached usually at elevated temperatures of about 70° to 100° C and consist of cotton or linen, but above all also those which consist or contain synthetic fibers, for example polyamide, polyester or polyacrylonitrile fibers and which are washed or bleached in general at lower temperatures of up to about 70° C, preferably at 30° to about 60° C. As such textiles, which are to be treated at low temperatures there are also to be understood goods of cellulose fibers or mixtures of cellulosic fibers and synthetic fibers finished to "easy care". An especial advantage of the activators of the invention to be used for inorganic per-compounds is that during the bleaching or washing of these textile materials to be treated at low temperatures a sufficient activation of the per-compounds takes place already at such low temperatures and that a good bleaching effect is obtained.

For the use in bleaching and washing agents for textiles together with the activators of the invention, there may be used above all inorganic per-compounds which in aqueous solution show a neutral to alkaline reaction, in particular the per-borates. Among the various per-borates, the sodium per-borate has the greatest importance. But also other per-borates, peroxido-hydrates of sodium ortho-, -pyro- or poly-phosphates as well as the peroxido-hydrates of alkali metal carbonates may be used.

The activators of the invention, as powders or granules, may be easily mixed with the other components of the oxidizing, bleaching or washing compositions. If, as usual, a washing powder which does not contain a per-compound is prepared by spray-drying, this powder is subsequently mixed with the inorganic per-compound and the activator, the powder having preferably a temperature of less than 30° C during the addition.

The activators of the invention to be incorporated into the oxidizing, bleaching and washing compositions have sufficient stability, so that in general an envelopment for improving the stability is not necessary. In principle, such an envelopment is also possible with the activators of the invention. Suitable enveloping substances which are soluble or at least swellable in the washing or bleaching liquid are, for example, water-soluble polyglycol ethers, polyvinyl alcohol, carboxymethyl-cellulose, methyl-, ethyl- or oxethyl-cellulose or also stearic acid.

The oxidizing, bleaching, washing and washing auxiliary compositions prepared with the activators of the invention ma contain the ingredients usual for such compositions. The mixture of activator and inorganic per-compound may amount to about 10 to 100 % of the total composition. Within textile washing compositions, nitrogen-containing proportion of inorganic peroxide compound to activator is in general between about 10 to 50% by weight. The other components of such washing compositions are above all tensides with a proportion of about 5 to 40, preferably 10 to 30, % by tetraacetyl-glycoluril and so-called builders, with a proportion of about 10 to 80, preferably 30 to 75, % by weight and other washing auxiliaries, for example dirt carriers, dyestuffs, perfumes and water in a proportion of together about 0 to 15, preferably 1 to 10, % by weight.

Among these auxiliary washing composition components and auxiliary substances are also optical brighteners. As such, there may be used, for example, derivatives of bis-(tri-azinyl-amino)-stilbenedisulfonic acid, preferably those with primary and/or secondary amines (German Patent Application No. 1,100,583 laid open to public inspection). Furthermore, there may be used: benzoxazoles such as 1,2-bis-(benzooxazolyl-2')-ethylene and 2,5-bis-(benzoxazolyl-2')-thiophene (German Patent Application No. 1,203,223 laid open to public inspection), pyrazolines such as 1-(4-sulfonamidephenyl)-3-(4-chlorophenyl)-Δ2-pyrazoline (German Patent Application No. 1,080,963 laid open to public inspection). Furthermore, there may be used brighteners for washing agents such as those known from German Patent Application No. 2,105,305 laid open to public inspection, in particular those corresponding to the formula (II):

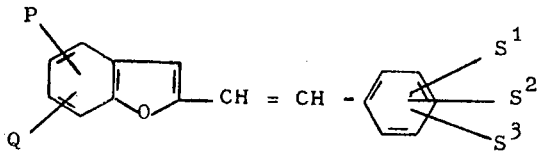

(II)

In the above formula (II), P and Q represent hydrogen or halogen atoms, lower alkyl or phenyl groups or together an annellated benzene nucleus or an alkylene group, $S^1$, $S^2$ and $S^3$ represent hydrogen or halogen atoms, lower alkyl or phenyl groups, carboxy or sulfo groups which may be functionally modified, acyl, acylamino, sulfone, lower alkoxy, dialkylamino or trialkylammonium groups, and in which the groups mentioned for P, Q, $S^1$, $S^2$ and $S^3$ may be substituted by not chromophoric groups. Particularly preferred are compounds of the formula (II) in which two of the radicals $S^1$, $S^2$ and $S^3$ are hydrogen atoms and the third is an electron-attracting radical standing in the ortho- or, preferably, in the para-position of the styryl group. As electron-attracting group, there may be taken into consideration above all the phenyl group or a carboxy group which may be functionally modified, in particular a cyano group or a low molecular carboalkoxy group.

The tensides contained in the cleansing and washing compositions may be uniform products or mixtures on the base of anion-active or non-ionic compounds. Thus, the tensides may consist totally or with a proportion of about 10 to 50% by weight of soaps, which may be derived from natural or synthetic fatty acids. The tensides may furthermore consist totally or to a proportion of about 30 to 70 % by weight of surface-active compounds of the sulfate or sulfone type. To these products belong, for example the alkylaryl sulfonates and aliphatic sulfonates such as, for example, alkanesulfonates, alkene sulfonates, oxyalkane sulfonates, and oxyalkene-sulfonates, furthermore fat alcohol sulfates, fatty acid alkylolamides and sulfatation products of oxalkylated alkyl phenols, fatty acid amides or fatty acid alkylolamides having a content of about 1 to 20 ethoxy and/or propoxy groups in the molecule and sulfatated mono-glycerides. The anion-active tensides which are suitable for the use in washing agents are described in detail, for example, in "Surface Active Agents and Detergents" by Schwartz, Perry and Berch, Vol. II (1958), pages 25 to 97 and in "Tenside, Textilhilfsmittel, Washrohstoffe" by K. Lindner, Volume 1 (1964), pages 555 – 557 and 565 –567.

The tensides of these washing compositions may be, totally or to a proportion of about 5 to 50% by weight, non-ionic raw materials for washing compositions. In these products the solubility in water of the hydrophobic portion of the molecule, which in general contains about 8 to 25 carbon atoms, is caused in the most simple case by the presence of poly-ether chains. Such non-ionic raw materials for washing compositions are described, for example in "Surface Active Agents and Detergents", Vol. II (1958), pages 120 to 143, and in "Tenside, Textilhilfsmittel, Waschrohstoffe" by K. Lindner, Volume I (1964), pages 557–558 and 567.

In addition to the non-ionic and anionic raw materials for washing compositions, the tenside portion of the washing compositions may also contain small amounts of up to about 8% by weight of foam stabilizers or foam inhibitors (cf. "Surface Active Agents and Detergents", Vol. II (1958), pages 315 –317).

The foaming power of the synthetic anionic or non-ionic tensides can also be reduced by the addition of soaps. With certain cominations of synthetic anionic tensides, non-ionic tensides and soap, the foaming power is strongly reduced. Furthermore, the addition compounds of propylene oxide to surface-active polyethylene glycol ethers are also very suitable owing to their low foaming power.

Another essential component of the washing compositions of the invention are so-called builders. Of these, at least one part about the 0.4 to 8-fold amount, referred to the total active washing substance, should have an alkaline reaction. These builders may be inorganic or organic salts having a weakly acidic, neutral or alkaline reaction, in particular those having properties leading to complex-formation. Suitable builder substances are for example alkali metal carbonates or silicates, mono-, di- or tri-alkali metal ortho-phosphates, di- or tetraalkali metal pyrophosphates as well as the meta-phosphates known as complex formers. As builder substances, there may furthermore be used the water-soluble salts of higher molecular polycarboxylic acids. As such, there enter into consideration the polymers of maleic acid, itaconic acid, mesaconic acid, fumaric acid, aconitic acid and methylene-malonic acid. Co-polymers of these acids one with the other or with other polymerizable substances such as ethylene, propylene, acrylic acid, crotonic acid, vinyl acetate, acryl amide and styrene are also suitable. As complex-forming builders, there may be used above all the polyphosphates having an alkaline reaction, in particular tri-polyphosphate. As organic complex formers which may be used as builder substances, there enter into consideration, for example nitrilotriacetic acid, ethylene-diamine-tetraacetic acid and similar compounds. Suitable inorganic and organic builder substances are described, for example, in "Surface Active Agents and Detergents", Vol. II, (1958), pages 289 to 315.

Products which have a stabilizing action on per-compounds and which are known under the term stabilizers for per-compounds may also be added to the mixtures of inorganic per-compounds and activators of the invention. These stabilizers may be water-insoluble or water-soluble products; they may be added in an amount of up to about 10%, referred to the weight of the per-compounds.

As water-insoluble stabilizers for per-compounds, there are known above all alkaline earth metal silicates, in particular magnesium silicates. These are products formed upon addition of aqueous alkali metal silicate solutions with calcium salts in the form of precipitates. Other water-insoluble stabilizers for per-compounds are, for example, water-containing tin oxides.

The water-soluble stabilizers which may be used completely or partially instead of the water-insoluble stabilizers are above all organic complex formers.

The aqueous baths of the oxidizing, bleaching or washing compositions may be adjusted to a desired pH-value in the weakly acidic, neutral or alkaline range depending on their use. The adjustment of the pH-value may be effected by the addition of suitable mineral acids, buffer substances or organic acids or bases. With washing baths, the pH-value will generally be in the range of from about 7 to 12 using a 1% solution of the washing agent.

The following Examples illustrate the invention. With the exception of the remission values for the determination of the degree of whitness, the percentual values are percents by weight.

EXAMPLE 1 a. A heavy duty detergent having the composition given below was prepared by spray-drying the following components:

12.0 % of sodium-dodecyl-benzene-sulfonate,
4.0 % of the sodium salt of a tallow fatty acid,
3.0 % of the addition product of 10 moles of EO and 1 mole of tallow fatty acid ethanol amide, 38.0 % of sodium tri-polyphosphate,
1.0 % of sodium ethylene-diamine-tetraacetate,
1.5 % of carboxymethyl-cellulose (having a viscosity of the 5 % solution at 20° C of 1500 cP),
0.2 % of optical brightener,
5.0 % of sodium meta-silicate,
3.0 % of magnesium silicate,
4.3 % of sodium sulfate,
18.0 % of sodium per-borate,
10.0 % of diacetyl-oxamide.

In the same manner as described under (a), there were prepared raw detergents of otherwise equal composition, but which contained instead of diacetyl-oxamide b. no activator (the proportion of diacetyl-oxamide was replaced by the same amount of sodium sulfate),
c. 10 % of diacetyl-urea,
d. di-n-butyryl-oxamide,
e. di-n-propionyl-oxamide.

Test samples of cotton, spoiled with tea and cocoa, were washed for 30 minutes, each time at 40° C and 60° C, with the washing agents specified under (a), (b), (c), (d) and (e), with a concentration of washing agent of 5 g/l and a goods-to-liquor ratio of 1 : 40 in water having 15° German hardness. Washing was effected in a Launderometer of Messrs. Atlas Electric Devices & Co (cf. ASTM Bulletin No. 140, 1946).

The brightenings obtained in these washing tests were measured by measurements of the whiteness degree with a remission photometer (Elrepho of Messrs. Carl Zeiss) (cf. Dr. Kurt Lindner "Tenside, Textilhilfsmittel, Waschrohstoffe", Vol. II, 1964, pages 1843 and 1844).

The results of these tests are compiled in the following Table.

| Washing agent | % Brightening Spoiling with tea 40°C | 60°C | Spoiling with cocoa 40°C | 60°C |
|---|---|---|---|---|
| a | 56 | 69 | 53 | 65 |
| b | 31 | 42 | 46 | 52 |
| c | 52 | 50 | 45 | 53 |
| d | 55 | 69 | 45 | 54 |
| e | 57 | 70 | 49 | 56 |

The results of these tests show the excellent superior brightening effect obtained on the test samples washed with the detergent formulations (a), (d) and (e) containing activators of the invention. Furthermore, the detergent formulations (a), (d) and (e) are distinguished by a very good stability to storage.

EXAMPLE 2

A scouring powder having the following composition was prepared by mixing the following components:

4.0 % of sodium-α-olefin-sulfonate containing 12 to 20 carbon atoms in the molecule,
0.5 % of the addition product of 10 moles of ethylene oxide and 1 mole of nonyl-phenol,
2.0 % of sodium tri-polyphosphate,
2.0 % of sodium perborate,
2.0 % of diacetyl-oxamide, and
89.5 % of quartz powder.

In comparison with a corresponding mixture which did not contain an activator but had an otherwise equal composition, this scouring powder showed a better cleansing action. In addition, when diluted in water at a ratio of, for example, 1 : 1, it showed an antimicrobial action against gram-positive and gram-negative bacteria.

We claim:

1. An oxidizing and bleaching composition useful in known oxidizing, bleaching and washing operations which composition consists essentially of an inorganic per-compound which is hydrogen peroxide, an alkali metal per oxide, perborate, perphosphate, percarbonate, persilicate, or persulfate, and as activator for the inorganic per-compound an acylated oxamide of the formula $$R_1-NH-\underset{\underset{O}{\|}}{C}-\underset{\underset{O}{\|}}{C}-NH-R_2$$

in which $R_1$ and $R_2$ are acyl groups of 2–9 carbon atoms, the amount of activator being such that about 0.5–8 acyl groups are present per active oxygen atom of the inorganic per-compound.

2. The composition of claim 1 wherein the activator-/inorganic per-compound weight ratio is about 1/1–1/2.

3. The composition of claim 1 wherein the activator is diacetyl-oxamide.

4. The composition of claim 1 wherein the inorganic per-compound is sodium perborate.

* * * * *